US007104575B2

(12) United States Patent
Kakita

(10) Patent No.: US 7,104,575 B2
(45) Date of Patent: Sep. 12, 2006

(54) INSIDE DOOR HANDLE DEVICE OF AUTOMOBILE

(75) Inventor: Kousuke Kakita, Kanagawa (JP)

(73) Assignee: Alpha Corporation, Kanagawa (JP)

( * ) Notice: Subject to any disclaimer, the term of this patent is extended or adjusted under 35 U.S.C. 154(b) by 208 days.

(21) Appl. No.: 10/830,100

(22) Filed: Apr. 23, 2004

(65) Prior Publication Data

US 2004/0212200 A1 Oct. 28, 2004

(30) Foreign Application Priority Data

Apr. 25, 2003 (JP) ..... P.2003-122307

(51) Int. Cl.
*E05B 3/00* (2006.01)

(52) U.S. Cl. ..... 292/348; 292/DIG. 53

(58) Field of Classification Search ..... 292/347, 292/336.3, 348, DIG. 31, DIG. 53; 16/412
See application file for complete search history.

(56) References Cited

U.S. PATENT DOCUMENTS 4,497,514 A * 2/1985 Moriya et al. ..... 292/336.3
5,282,657 A * 2/1994 Clinch et al. ..... 292/336.3
5,551,737 A * 9/1996 Clavin ..... 292/169
6,106,055 A * 8/2000 Fischer ..... 296/214
6,666,496 B1 * 12/2003 Rettig ..... 296/146.1

FOREIGN PATENT DOCUMENTS

JP 2000-87601 3/2000

* cited by examiner

*Primary Examiner*—Gary Estremsky
(74) *Attorney, Agent, or Firm*—Arent Fox PLLC

(57) ABSTRACT

An inside door handle device of an automobile comprises: a handle case; a cover body for covering a fixing portion of the handle case to a vehicle body; a hollow formed on the rising wall of the hand-operating recess portion; an engaging step portion formed in a bottom wall of the hollow; and an engaging leg for release operation, formed in the cover body.

The engaging leg for release operation includes an engaging portion elastically engaged with the engaging step portion; and a hooking protrusion capable of being hooked from above, accommodated in the hollow in the engaging state with the engaging step portion.

7 Claims, 5 Drawing Sheets

INSIDE DOOR HANDLE DEVICE OF AUTOMOBILE

BACKGROUND OF THE INVENTION

The present invention relates to an inside door handle device of an automobile.

An inside handle device fixed to an inner panel with clamping pieces is known, for example as disclosed in JP-A-2000-087601. The inside handle device in JP-A-2000-087601 includes: a handle case for pivotally supporting an operation handle and lock lever; and a decorative frame elastically engaged with the handle case. This inside handle device is attached to a vehicle body (inner panel) in such a manner that, first, the handle case is fixed to the inner panel and then the decorative frame is fixed so that the door trim is pinched in the peripheral edge.

However, the above conventional example is disadvantageous as follows. Clamping pieces such as screws used for fixing the decorative frame are exposed outside at the point of time when the work of attaching the inside handle device to the inner panel has been completed. Therefore, the looks of the inside handle device is ugly. In order to solve the above problems, it is possible to take countermeasures of covering head portions of the clamping pieces with cap members, the diameters of which are somewhat larger than the diameters of the head portions of the clamping pieces. Even in this case in which the above countermeasures have been taken, users may inevitably feel a sense of incongruity in the design of the inside handle device.

SUMMARY OF THE INVENTION

The present invention has been accomplished to solve the above problems of the prior art. It is an object of the present invention to provide an inside door handle device of an automobile capable of enhancing a sense of beauty by completely covering a fixing portion of the inside door handle device to a vehicle body.

According to the present invention, the above object can be accomplished by providing an inside door handle device of an automobile comprising: a handle case connected with an operation handle, including a hand-operating recess portion partitioned by a rising wall in a peripheral edge; a cover body, for covering a fixing portion of the handle case to a vehicle body, elastically engaged and fixed onto the surface side of the handle case, composing a bottom wall of the hand-operating recess portion; a hollow formed on the rising wall of the hand-operating recess portion; an engaging step portion formed in a bottom wall of the hollow; and an engaging leg for release operation formed in the cover body.

An engaging portion extends from below to above, wherein the upper end portion of which is elastically engaged with the engaging step portion; and a hooking protrusion capable of being hooked from above, is accommodated in the hollow when in the engaged state with the engaging step portion.

In general, the inside door handle device is fixed to door inner panel under the condition that the operation handle and others are assembled into the handle case so that the working property can be enhanced. In order to enhance the working property of attaching the inside door handle device to inner panel, it is desired that a large working space is widely open forward. Therefore, in order to make a user's finger reach the reverse side of the operation handle, the hand-operating recess portion, which is provided in the handle case, is used as the fixing portion.

On the other hand, it is necessary that the inside of inner panel can not be seen by a user after the handle device has been attached to inner panel. Therefore, the periphery of the hand-operating recess portion is surrounded by the rising walls.

The present invention has been accomplished while attention is being given to this point. When the fixing portion is covered with the cover body composing the bottom wall of the hand-operating recess portion, it is possible to prevent the generation of a sense of incongruity which is caused by locally attaching caps and others to the fixing portion. At the same time, when the rising walls are provided at the connecting portion of the cover body, the working property of detaching the cover body can be enhanced.

In the engaging leg for release operation which is used for maintaining the attaching state of the cover body, the hooking protrusion is formed at a position where the hooking protrusion can be operated from above. Only by the operation that the engaging leg for release operation is elastically deformed by hooking an appropriate tool at this hooking protrusion, the cover body can be simply detached.

Since the hooking protrusion is accommodated in the hollow formed on the rising wall, it is difficult for a user to see the hooking protrusion when the handle device is attached to inner panel. Therefore, the beauty of the handle device is seldom spoiled.

Further, when the second engaging portion is formed in the cover body and arranged at a position opposed to the side edge on which the above engaging leg for release operation is formed and the entire cover body is pushed to the second engaging portion side by the engaging leg for release operation, rattle of the cover body can be prevented.

BRIEF DESCRIPTION OF THE DRAWINGS

FIGS. 3A to 3C are views showing a cover body, wherein FIG. 3A is a plan view, FIG. 3B is a front view and FIG. 3C is a perspective view showing the reverse side.

FIGS. 4A to 4C are views showing a state in which a cover body is attached, wherein FIG. 4A is a sectional view taken on line IV A—IV A in FIG. 1, FIG. 4B is a sectional view taken on line IV B—IV B in FIG. 1 and FIG. 4C is a sectional view taken on line IV C—IV C in FIG. 1.

FIGS. 5A to 5D are schematic illustrations showing the operation of detaching a cover body, wherein FIG. 5A is a sectional view taken on line V A—V A in FIG. 1, FIG. 5B is an enlarged view of portion A in FIG. 5A, FIG. 5C is an enlarged view of portion A of FIG. 5A showing a state in which detaching operation of the cover body is started, and FIG. 5D is an enlarged view of portion A of FIG. 5A showing a state in which engagement of an engaging portion is released.

DESCRIPTION OF THE PREFERRED EMBODIMENTS

Figure 1:
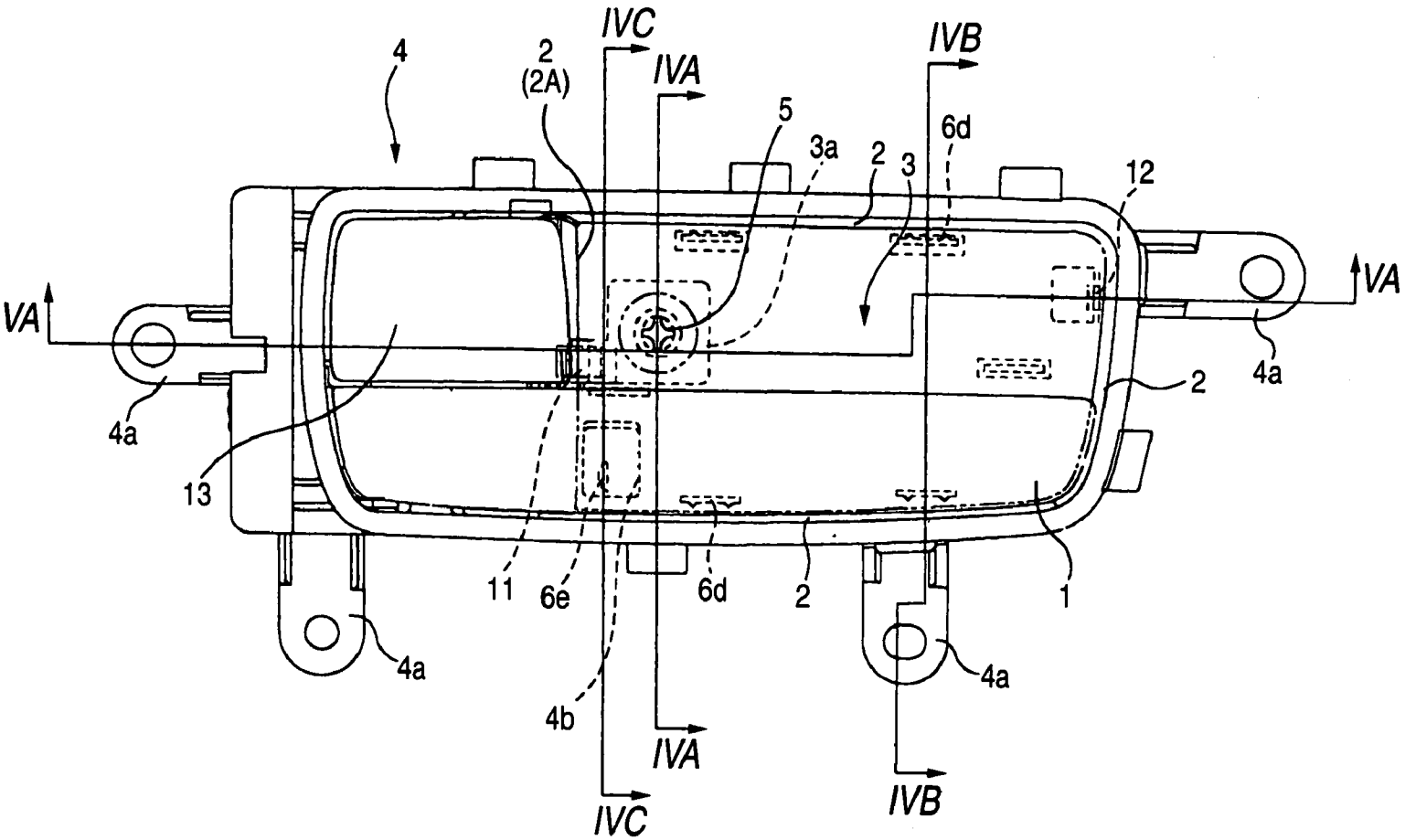
FIG. 1 is a front view showing an inside handle device of the present invention.
Figure 2:
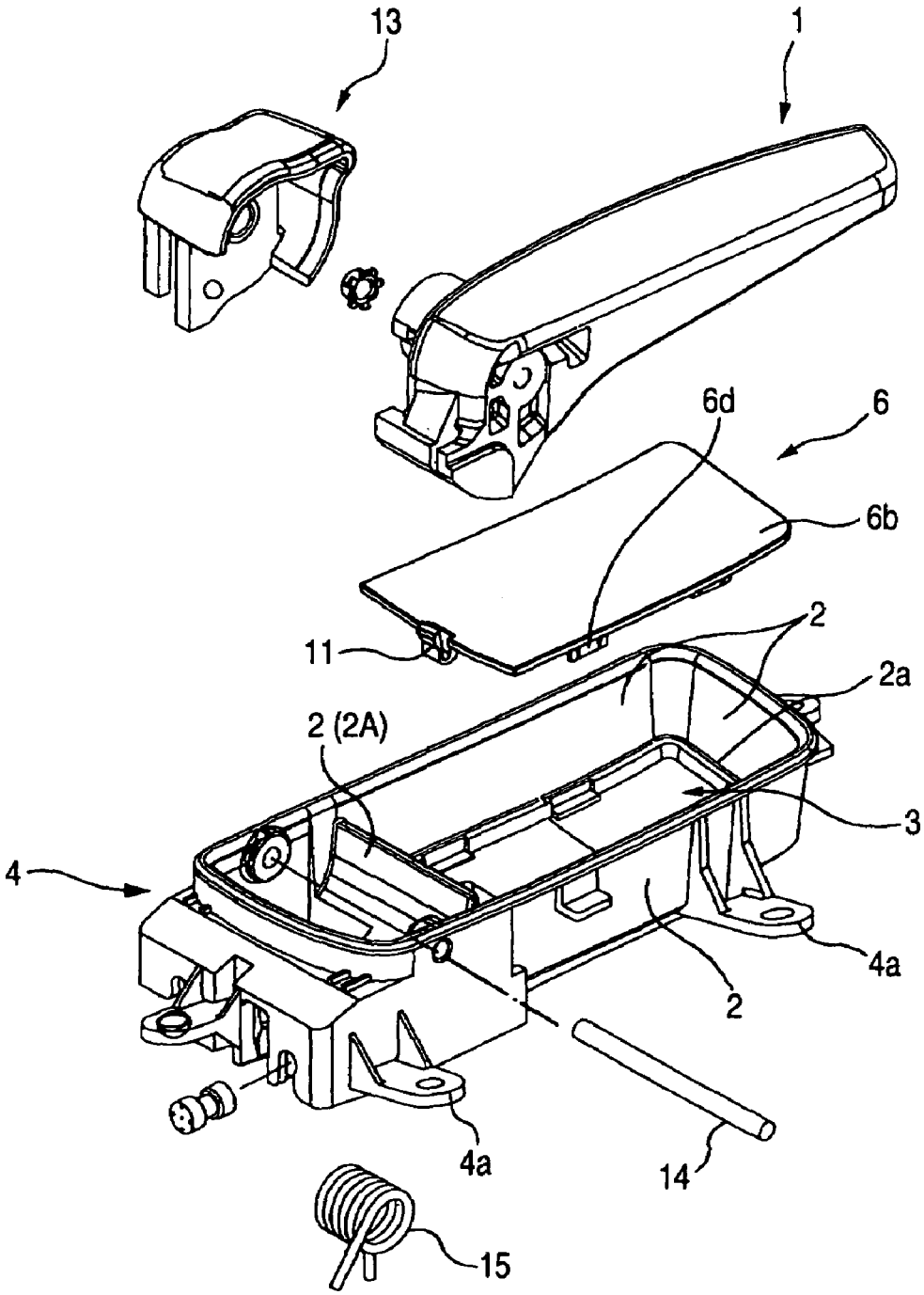
FIG. 2 is an exploded perspective view of FIG. 1.

As shown in FIGS. 1 and 2, the inside handle device is composed in such a manner that the operation handle 1 and the lock lever 13 are pivotally connected round the shaft 14 in the handle case 4. The operation handle 1 and the lock lever 13 are connected to a lock device (not shown) via a rod and others not shown in the drawing. When the operation handle 1 is turned resisting a reaction force of the spring 15, the door can be opened. When the lock lever 13 is operated, the door opening operation conducted by the operation handle 1 with respect to the lock device is canceled. Therefore, the door can be prevented from being opened while the vehicle is running.

The handle case 4 is formed into a frame shape. The inside of the frame is divided into a region in which the shaft of the operation handle 1 is accommodated and a residual region by the shielding wall 2A formed at the base end portions of the operation handle 1 and the lock lever 13. This residual region becomes the hand-operating recess portion 3 surrounded by the rising walls 2 including the side walls of the frame portion and the shielding wall 2A.

Figure 4A:
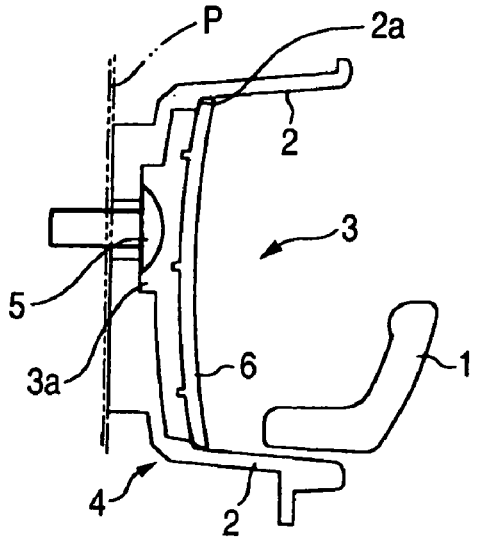

The inside handle device is attached to door inner panel P as follows. First, the operation handle 1 and the lock lever 13 are connected to the handle case 4. Then, the attaching portions 4*a* protruding outside the handle case 4 and the attaching portion 3*a* formed in the region on the hand-operating recess portion 3 side are fixed to door panel P. As shown in FIG. 4A, when the handle case 4, to which the operation handle 1 has been assembled, is attached to door inner panel P, a head portion (the fixing portion 5) of the bolt for fixing the attaching portion 3*a* of the frame to door panel P is exposed onto the surface side. In order to hide the head portion of the bolt, the cover body 6 made of synthetic resin is attached.

Figure 3A:
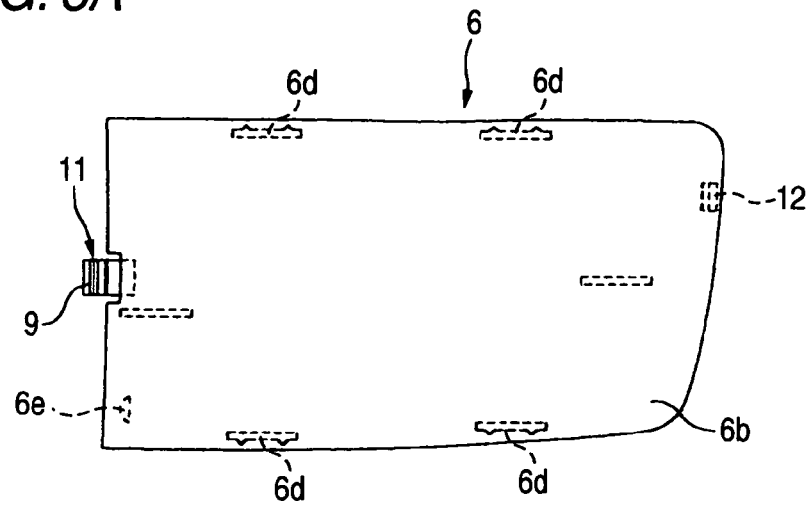
Figure 3B:
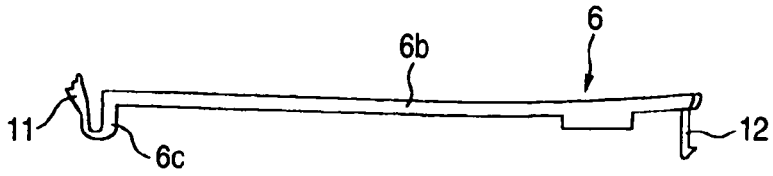
Figure 3C:
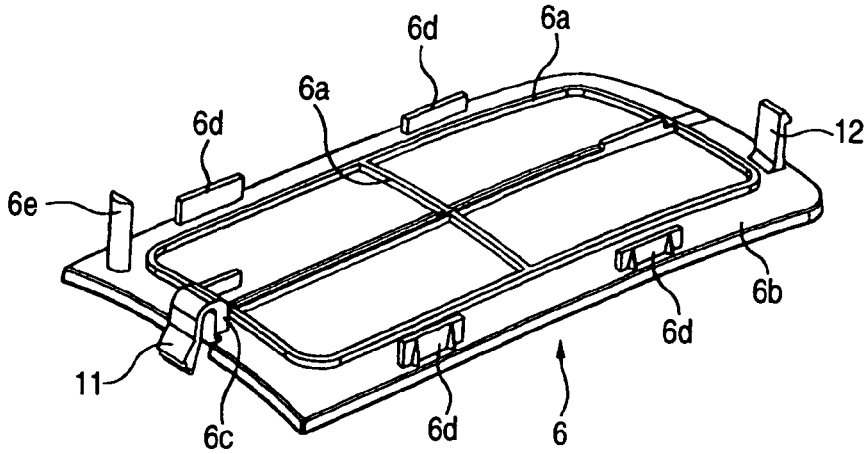

In order to prevent the generation of a sense of incongruity which is caused when only the head portion 5 of the bolt is hidden, the cover body 6 is formed so that it can cover the substantially entire face of the bottom portion of the hand-operating recess portion 3 and form the bottom wall of the hand-operating recess portion 3. The cover body 6 includes: a plate-shaped main body portion 6*b* which is reinforced by ribs 6*a* provided on the reverse side; an engaging leg 11 for release operation; and a second engaging portion 12 as shown in FIG. 3A, FIG. 3B and FIG. 3C.

The engaging leg 11 for release operation is formed in such a manner that the protruding piece 6*c*, which protrudes from the center of the short side portion of the main body 6*b* onto the reverse face side, is folded back upward being formed into a U-shape. At the forward end portion of this engaging leg 11 for release operation, the engaging portion 9 engaged with the engaging step portion 7, which is provided on the handle case 4 side, is formed.

The second engaging portion 12 is formed in the short side portion opposed to the peripheral edge on which the engaging leg 11 for release operation is formed. As described later, in order to prevent the second engaging portion 12 from coming into contact with the rising wall 2 and damaging the rising wall 2, the forward end portion of the second engaging portion 12 is arranged so that it can not protrude from the peripheral edge of the cover body 6 in the plan view.

Figure 4B:
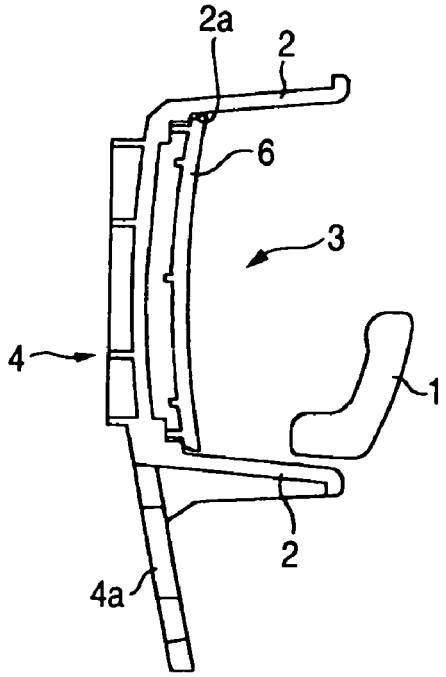
Figure 4C:
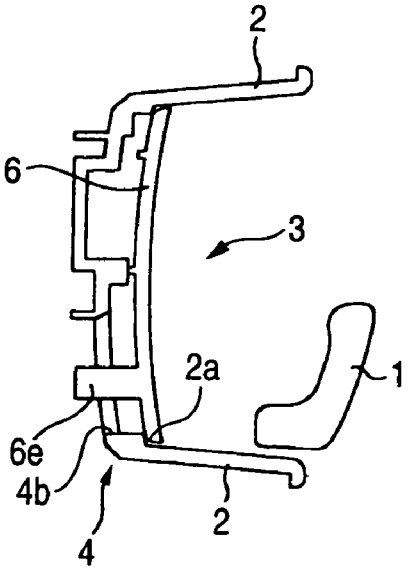

As shown in FIG. 4A, FIG. 4B and FIG. 4C, the cover body 6 is attached to the handle case 4 while it is being supported by the supporting step portions 2*a* formed in the base end portion of the rising wall 2 of the hand-operating recess portion 3. In order to prevent the occurrence of a positional slippage of the cover body 6, the positioning piece 6*d* is protruded from the reverse face of the cover body 6.

In this connection, in FIGS. 3A to 4C, reference mark 6*e* is a dummy gate for introducing a submarine gate remained in the cover body 6 so that the gate cutting work can be omitted and the molding work property can be enhanced at the time of molding work. In this connection, in order to prevent the dummy gate 6*e* from obstructing the cover body 6 when the cover body 6 is attached to the handle case 4, the opening 4*b*, into which the dummy gate 6*e* is inserted, is provided on the handle case 4.

Figure 5A:
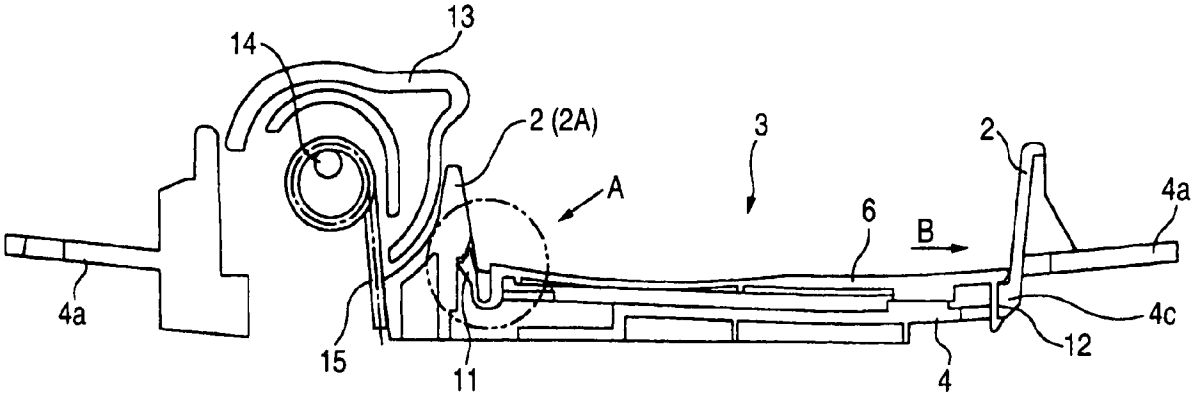
Figure 5B:
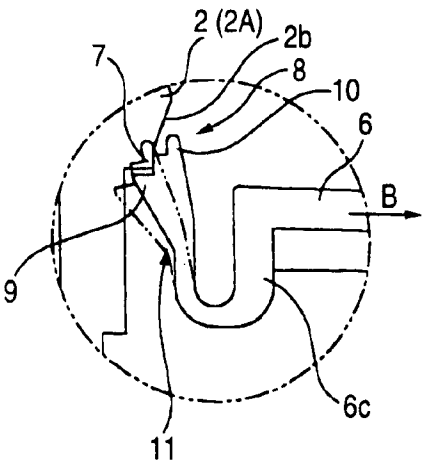

When the cover body 6 is attached to the handle case 4, its disconnection from the handle case 4 is prevented by engaging the second engaging portion 12 and the engaging leg 11 for release operation with the handle case 4. In the case of attaching the cover body 6 to the handle case 4, the engaging leg 11 for release operation is elastically bent from the position shown by the chain line in FIG. 5B and engaged with the engaging step portion 7. In the cover body 6, a pushing force to push the cover body 6 to the second engaging portion 12 side is generated by the elastic restoring force of the engaging leg 11 for release operation as shown by arrow B in FIG. 5A and FIG. 5B. As a result, the second engaging portion 12 and the engaging wall face 4*c* on the handle case 4 side come into pressure contact with each other. Therefore, rattle of the cover body 6 can be prevented by this pressure contact of the second engaging portion 12 and the engaging wall face 4*c* on the handle case 4 side in addition to the sliding contact of the aforementioned positioning piece.

Figure 5C:
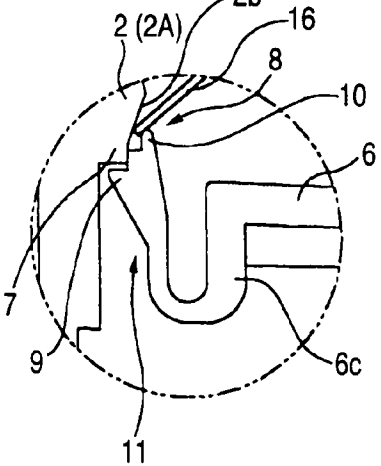
Figure 5D:
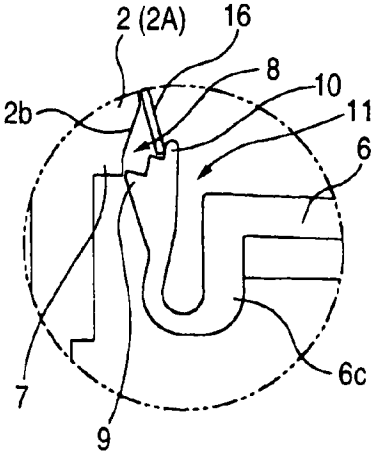

In the case of detaching the cover body 6 attached to the handle case 4 in this way, as shown in FIG. 5D, the engaging leg 11 for release operation is bent so that the engaging portion 9 and the engaging step portion 7 can be released from each other. In order to simplify the engagement release operation, the hooking protrusion 10 is formed at the end portion of the engaging leg 11 for release operation.

In order to prevent the hooking protrusion 10 from standing out when the cover body 6 is attached to the handle case 4, the hollow 8, the wall face of which is composed of an inclined face 2*b*, is formed on the rising wall 2 of the handle case 4. Therefore, the hooking protrusion 10 can be accommodated in the hollow 8 without protruding from an extension face of the rising wall 2. The engaging step portion 7 is formed in the bottom portion of the hollow 8.

Accordingly, in this embodiment, the cover body 6 is simply detached from the handle case 4 as follows. As shown in FIG. 5C, the tool 16, the forward end portion of which is sharp, is inserted into a gap formed between the inclined face 2*b* and the hooking protrusion 10, and the hooking protrusion 10 is moved to the inside of the handle case 4. Since the inclined face 2*b* is used as the insertion guide, the tool 16 can be easily inserted even into the inner position divided by the rising wall 2. Further, even when the inclined face 2*b* is damaged by the tool in the case of inserting the tool 16 into the gap or in the case of moving the hooking protrusion 10 inside the handle case 4, since the inclined face 2*b* is located at the inner position of the hollow 8, no damage stands out for the user.

As can be seen from the above explanations, according to the present invention, the beauty of the inside door handle device can be enhanced by completely covering the fixing portion for fixing the inside door handle device to a vehicle body.

What is claimed is:

1. An inside door handle device of an automobile comprising:

a handle case connected with an operation handle, the handle case including a recess defined therein, the recess being partitioned by a wall extending vertically from a bottom surface of the recess;

a cover body;

a fixing portion that secures the handle case to a body of the automobile, wherein the cover body is elastically engaged and fixed to the bottom surface of the recess;

a hollow portion formed on the wall extending vertically from the bottom surface of the recess;

an engaging step portion formed in a bottom wall of the hollow portion; and an engaging leg formed in and extending from the cover body, the engaging leg including:

an engaging portion extending in an up and down direction from a plate-shaped main body portion of the cover body, wherein an end portion of the engaging portion elastically engages the engaging step portion; and a hooking protrusion capable of being hooked from above, accommodated in the hollow portion during an engaged state with the engaging step portion.

2. The inside door handle device according to claim 1, wherein the cover body includes a second engaging portion, for engaging with the handle case, formed on a peripheral edge opposing to the engaging leg, and wherein the engaging leg pushes the cover body toward the second engaging portion due to an elastic restoring force during the engaged state.

3. The inside door handle device according to claim 1, wherein the operation handle is pivotally connected to the handle case by a shaft.

4. The inside door handle device according to claim 3, further comprising a lock lever pivotally connected to the shaft.

5. The inside door handle device according to claim 1, wherein the wall extending vertically from the bottom surface of the recess defines a handle accommodating region and a residual region.

6. The inside door handle device according to claim 1, wherein the cover body comprises:

a main body;

a rib extending toward the bottom surface of the recess;

the engaging leg;

a second engaging portion; and a plurality of positioning pieces also extending toward the bottom surface of the recess.

7. The inside door handle device according to claim 6, wherein the engaging leg is disposed on an end opposite to another end where the second engaging portion is disposed.

* * * * *